US007265496B2

(12) United States Patent
Allen

(10) Patent No.: US 7,265,496 B2
(45) Date of Patent: Sep. 4, 2007

(54) JUNCTION CIRCUIT FOR LED LIGHTING CHAIN

(75) Inventor: David Allen, Yardley, PA (US)

(73) Assignee: Fiber Optic Designs, Inc., Yardley, PA (US)

( * ) Notice: Subject to any disclaimer, the term of this patent is extended or adjusted under 35 U.S.C. 154(b) by 31 days.

(21) Appl. No.: 11/232,885

(22) Filed: Sep. 23, 2005

(65) Prior Publication Data

US 2007/0070622 A1 Mar. 29, 2007

(51) Int. Cl.
*H05B 37/00* (2006.01)

(52) U.S. Cl. ..... 315/185 R; 315/185 S; 362/251; 362/252

(58) Field of Classification Search ..... 315/185 R, 315/185 S; 362/249, 251, 252
See application file for complete search history.

(56) References Cited

U.S. PATENT DOCUMENTS

| | | | |
|---|---|---|---|
| 3,758,771 | A | 9/1973 | Frohardt et al. |
| 3,950,738 | A | 4/1976 | Hayashi et al. |
| 4,223,248 | A | 9/1980 | Tong |
| 4,271,408 | A | 6/1981 | Teshima et al. |
| 4,298,869 | A | 11/1981 | Okuno |
| 4,316,125 | A | 2/1982 | Noguchi |
| 4,321,598 | A | 3/1982 | Warner |
| 4,329,625 | A | 5/1982 | Nishizawa et al. |
| 4,365,244 | A | 12/1982 | Gillessen et al. |
| 4,367,471 | A | 1/1983 | Gillessen |
| 4,396,823 | A | 8/1983 | Nihei et al. |
| 4,420,251 | A | 12/1983 | James et al. |
| 4,521,835 | A | 6/1985 | Meggs et al. |
| 4,595,920 | A | 6/1986 | Runyan |
| 4,652,981 | A | 3/1987 | Glynn |
| 4,675,575 | A | 6/1987 | Smith et al. |
| 4,727,603 | A | 3/1988 | Howard |
| 4,753,546 | A | 6/1988 | Witz et al. |
| 4,839,777 | A | 6/1989 | Janko et al. |
| 4,843,280 | A | 6/1989 | Lumbard et al. |
| 4,857,920 | A | 8/1989 | Katoaoka et al. |

(Continued)

FOREIGN PATENT DOCUMENTS

| | | |
|---|---|---|
| CA | 1118394 | 2/1982 |

(Continued)

OTHER PUBLICATIONS

ALDERBROOK Industries Ltd., 1998 Sales Catalogue, p. 16.

(Continued)

*Primary Examiner*—David H. Vu
(74) *Attorney, Agent, or Firm*—Berenato, White & Stavish

(57) ABSTRACT

An LED light string where the parallel connections of additional series blocks of LED lamps are added through an intermediate or junction circuit. The first half of the rectifying diode pair in the junction circuit receive the series connected LED lamps positive connection, complete the rectification of the first rectifying diode pair and couple with the parallel wires of the lighting chain, thus completing the circuit. The second diode pair contained in the junction circuit forms a second, independent circuit by coupling with the lighting chain parallel (AC) wires the join to form the series connection for the subsequent LED lamps connected in series. This circuit is completed by a subsequent junction circuit, or by the diode pair contained in or around the end plug.

19 Claims, 4 Drawing Sheets

U.S. PATENT DOCUMENTS

| | | | |
|---|---|---|---|
| 4,870,547 | A | 9/1989 | Crucefix |
| 4,939,426 | A | 7/1990 | Menard et al. |
| 4,954,822 | A | 9/1990 | Borenstein |
| 4,959,766 | A | 9/1990 | Jain |
| 4,984,999 | A | 1/1991 | Leake |
| 5,027,037 | A | 6/1991 | Wei |
| 5,087,212 | A | 2/1992 | Hanami |
| 5,094,632 | A | 3/1992 | Chen et al. |
| 5,130,897 | A | 7/1992 | Kuzma |
| 5,155,669 | A | 10/1992 | Yamuro |
| 5,187,377 | A | 2/1993 | Katoh |
| 5,193,895 | A | 3/1993 | Naruke et al. |
| 5,257,020 | A | 10/1993 | Morse |
| 5,313,187 | A | 5/1994 | Choi et al. |
| 5,323,305 | A | 6/1994 | Ikeda et al. |
| 5,357,078 | A | 10/1994 | Smith et al. |
| 5,366,780 | A | 11/1994 | Rapisarda |
| 5,404,282 | A | 4/1995 | Klinke et al. |
| 5,410,458 | A | 4/1995 | Bell |
| 5,436,809 | A | 7/1995 | Brassier et al. |
| 5,457,450 | A | 10/1995 | Deese et al. |
| 5,463,280 | A | 10/1995 | Johnson |
| 5,495,147 | A | 2/1996 | Lanzisera |
| 5,504,398 | A | 4/1996 | Rothenbuhler |
| 5,528,484 | A | 6/1996 | Hayashi |
| 5,567,037 | A | 10/1996 | Ferber |
| 5,639,157 | A | 6/1997 | Yeh |
| 5,649,755 | A | 7/1997 | Rapisarda |
| 5,661,645 | A | 8/1997 | Hochstein |
| 5,663,719 | A | 9/1997 | Deese et al. |
| 5,669,703 | A | 9/1997 | Wheeler et al. |
| 5,726,535 | A | 3/1998 | Yan |
| 5,762,419 | A | 6/1998 | Yan |
| 5,806,965 | A | 9/1998 | Deese |
| 5,808,592 | A | 9/1998 | Mizutani et al. |
| 5,828,183 | A | 10/1998 | Wang et al. |
| 5,887,967 | A | 3/1999 | Chang |
| 5,920,827 | A | 7/1999 | Baer et al. |
| 5,924,784 | A | 7/1999 | Chliwnyj et al. |
| 5,936,599 | A | 8/1999 | Reymond |
| 5,941,626 | A | 8/1999 | Yamurd |
| 5,962,971 | A | 10/1999 | Chen |
| 5,988,831 | A | 11/1999 | Pan |
| 6,072,280 | A | 6/2000 | Allen |
| 6,183,310 | B1 | 2/2001 | Shu |
| 6,190,021 | B1 | 2/2001 | Huang |
| 6,200,003 | B1 | 3/2001 | Tseng |
| 6,261,019 | B1 | 7/2001 | Furukawa |
| 6,361,198 | B1 | 3/2002 | Reed |
| 6,461,019 | B1 | 10/2002 | Allen |
| 6,505,954 | B2 | 1/2003 | Chen |
| 6,830,358 | B2 | 12/2004 | Allen |
| 6,972,528 | B2 * | 12/2005 | Shao ..... 315/185 R |
| 2002/0145874 | A1 | 10/2002 | Kahl |
| 2002/0149938 | A1 | 10/2002 | Allen |
| 2002/0191393 | A1 | 12/2002 | Chen |
| 2003/0015968 | A1 | 1/2003 | Allen |
| 2003/0147245 | A1 | 8/2003 | Chen |
| 2005/0168156 | A1 | 8/2005 | Li et al. |

FOREIGN PATENT DOCUMENTS

| | | |
|---|---|---|
| EP | 0 805 304 A2 | 11/1997 |
| GB | 2264555 | 9/1993 |
| JP | A 58-119682 | 7/1983 |
| JP | A 3-273495 | 12/1991 |
| WO | WO 00/13469 | 3/2000 |

OTHER PUBLICATIONS

Pages from Canadian Tourism Commission web-site, www.travelcanada.ca, Jul. 23, 2004, pp. 1-5.

Pages from www.kropla.com web site, Jul. 23, 2004, pp. 1-10.

"MicroElectronics Circuits", Third Edition, Sendra & Smith, Saunders College Publishing, 1991, pp. 126-128, and Exercise 3.12 on pp. 136-137.

"Optoelectronics/Fiber-Optics Applications Manual", Second Edition, McGraw-Hill Book Company, 1981, pp. 2.18-2.19.

Canadian Standards Association Approval Form, dated Jun. 5, 1998.

* cited by examiner

JUNCTION CIRCUIT FOR LED LIGHTING CHAIN

FIELD OF THE INVENTION

The present invention relates to the field of decorative lighting and particularly a junction circuit to be used to connect LED lighting chains having multiple series connections.

BACKGROUND

LEDs are becoming increasingly popular as a light source in decorative and Christmas lights due to their reliability, energy savings, longevity, and cool operation. Manufacturers of decorative light strings are constantly working to maximize the brightness and benefits of LEDs as a light source as well as reduce production cost to narrow the gap between traditional, incandescent and LED light string cost.

It is known in the art the use of a DC power supply to power LED lamps maximize LED brightness. It is further known in the art that reduction of DC ripple in a rectified (AC to DC) circuit is desirable to reduce peak voltage, placing stress on the LED lamps and thus shortening their lifespan.

FIG. 3 shows a prior art embodiment (U.S. patent application Ser. No. 10/836,062) of an LED lighting chain. The prominent feature of this prior art is circuit rectification wherein the rectifying diodes (31, 32, 33, 34) are installed in split pairs in an attempt to save wire, thus reducing cost.

FIG. 4 also shows a prior art embodiment (U.S. patent application Ser. No. 10/836,062) wherein multiple series connections (30) are employed. According to this embodiment of the invention the number of wires required in the manufacture of the light chain increases one-for-one with each parallel connection of LEDs in series added to the lighting chain. This defeats the wire saving purpose and creates an additional safety hazard.

The lighting chains shown in FIG. 3 and FIG. 4 would typically be rated for 3 Amps or 5 Amps. As parallel connections of series blocks are added the increased current flow through the rectifying diodes quickly overheat them causing a fire hazard. A load of only one Amp (⅓ to ⅕ of the circuit capacity) causes the rectifying diodes to overheat sufficiently to melt the surrounding plastic.

SUMMARY OF THE INVENTION

In view of the disadvantages of the prior art, the object of the present invention is to provide an intermediate or junction circuit structure that can solve the problems mentioned previously.

To attain the aforesaid object, parallel connections of additional series blocks of LED lamps are added through the intermediate or junction circuit, eliminating the additional series wires as well as the safety hazard caused by overheating the rectifying diodes due to the additional current flow.

The first half of the rectifying diode pair in the junction circuit receive the series connected LED lamps positive connection, complete the rectification of the first rectifying diode pair contained in or around the plug portion of the lighting chain and couple with the parallel wires of the lighting chain, thus completing the circuit. A resistor and capacitor is added to the series connection in keeping with the specification of the prior art, although this is not the optimal circuit arrangement.

The second diode pair contained in the junction circuit form a second, independent circuit by coupling with the lighting chain parallel (AC) wires the join to form the series connection for the subsequent LED lamps connected in series. This circuit to be completed by a subsequent junction circuit, or by the diode pair contained in or around the end plug per the prior art.

It is also envisioned that the LED lighting chain further comprises a voltage-reducing device operably connected between at least one of the first and second LED serial sets and the positive ends of the rectifying diodes of the second group and the positive ends of the first two junction diodes. The voltage reducing device is preferably but not necessarily a resistor in series with a capacitor.

In accordance with the invention, the voltage reducing device and the two rectifying diodes of the second group are contained in packaging for the rear plug and the two rectifying diodes of the first group are contained in packaging for the front plug.

Preferably, the front and rear plugs comprise a common household plug connector configured to be connected to a supply voltage. Alternatively, the rear plug may be a dummy plug coupled in parallel to the front plug.

The supply voltage may be 110 or 220 volts.

BRIEF DESCRIPTION OF DRAWINGS

F1G. 1 is a schematic circuit diagram illustrating the junction circuit used in an LED lighting chain with 2 series blocks of LED lamps in accordance with an embodiment of this invention.

F1G. 1A is a schematic circuit diagram illustrating an embodiment of this invention where the voltage reducing device and the two rectifying diodes of the second group are contained in common household rear plug and the two rectifying diodes of the first group are contained in a common household front plug.

DETAILED DESCRIPTION

Figure 1:
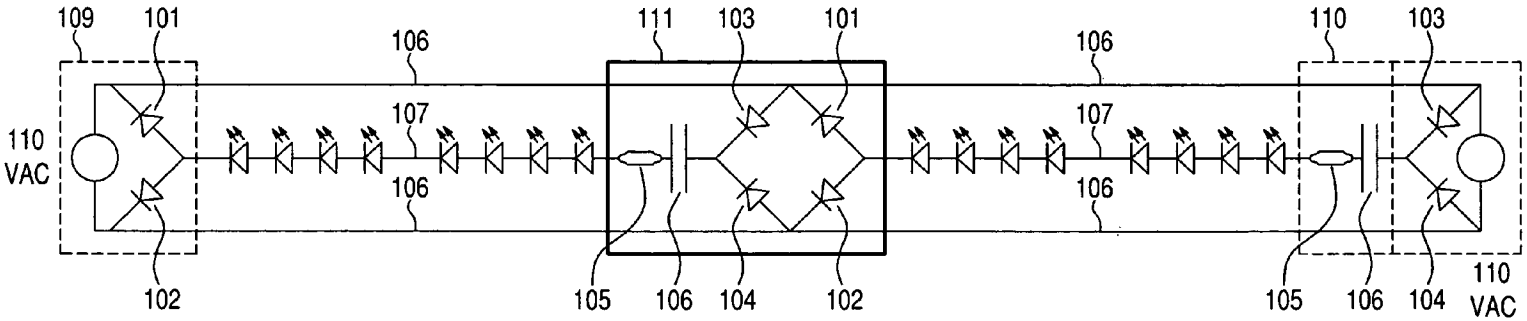
FIG. 1B is a schematic circuit diagram illustrating an embodiment of this invention where the voltage reducing device and the two rectifying diodes of the second group are contained in dummy rear plug and the two rectifying diodes of the first group are contained in a common household front plug.
Figure 1A:
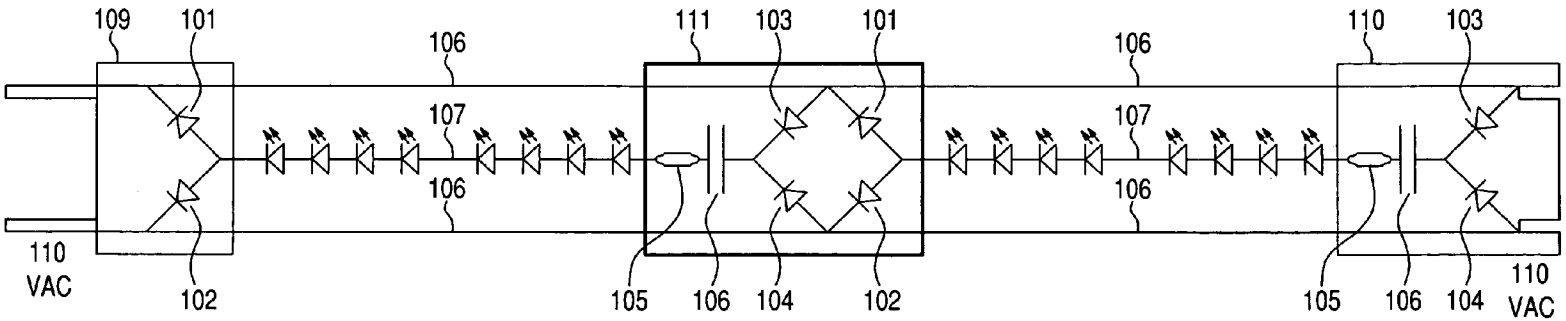
Figure 1B:
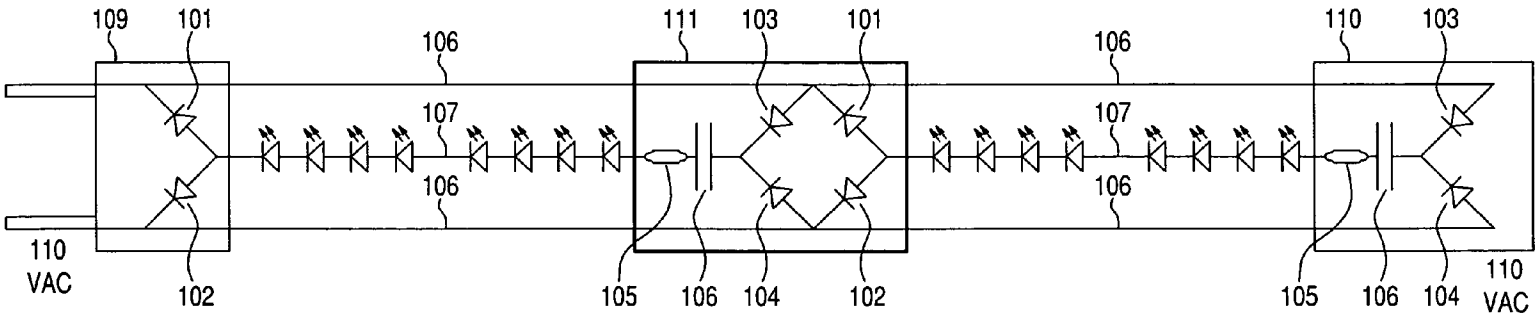

Reference will now be made to the exemplary embodiments illustrated in the drawings, and specific language will be used herein to describe the same.

Figure 2:
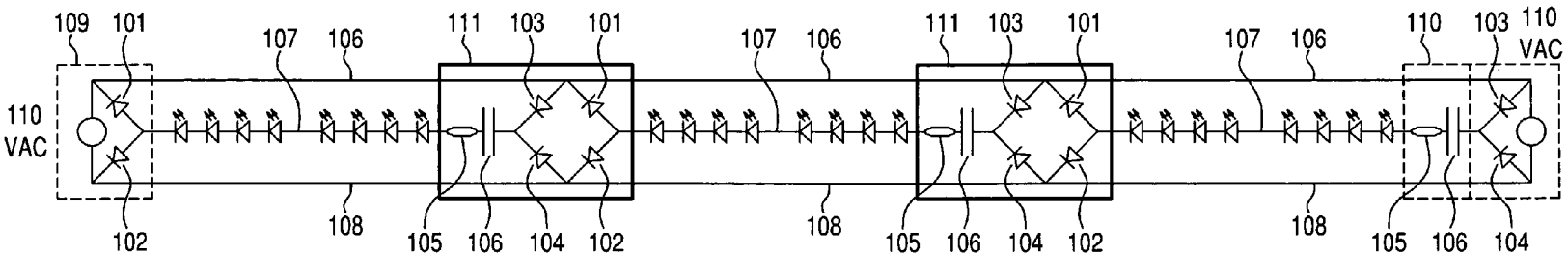
FIG. 2 is a schematic circuit diagram illustrating the junction circuit used in an LED lighting chain with 3 series blocks of LED lamps in accordance with an embodiment of this invention.
Figure 2A:
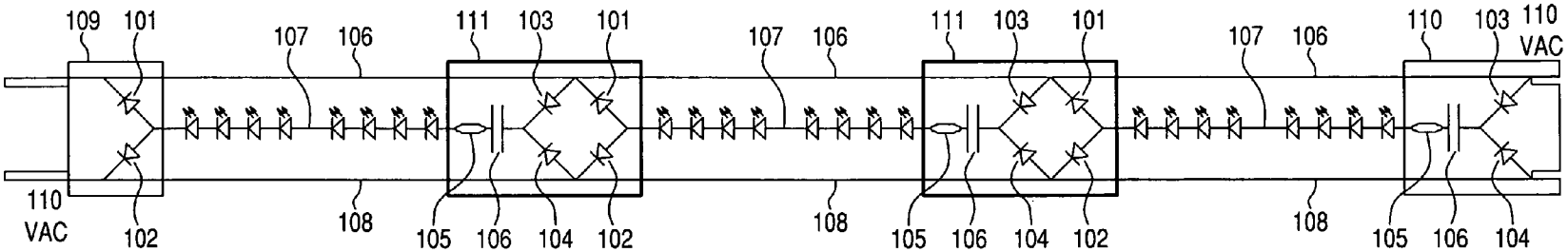
FIG. 2A is a schematic circuit diagram illustrating an embodiment of this invention where the voltage reducing device and the two rectifying diodes of the second group are contained in common household rear plug and the two rectifying diodes of the first group are contained in a common household front plug.
Figure 2B:
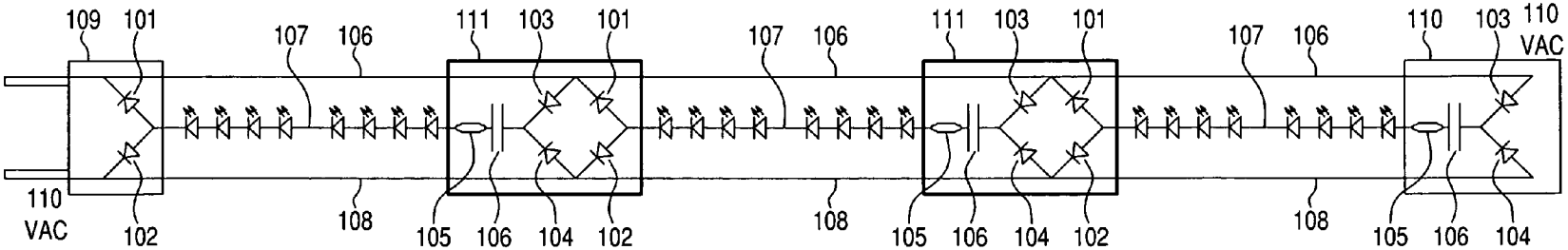
FIG. 2B is a schematic circuit diagram illustrating an embodiment of this invention where the voltage reducing device and the two rectifying diodes of the second group are contained in dummy rear plug and the two rectifying diodes of the first group are contained in a common household front plug.
Figure 3:
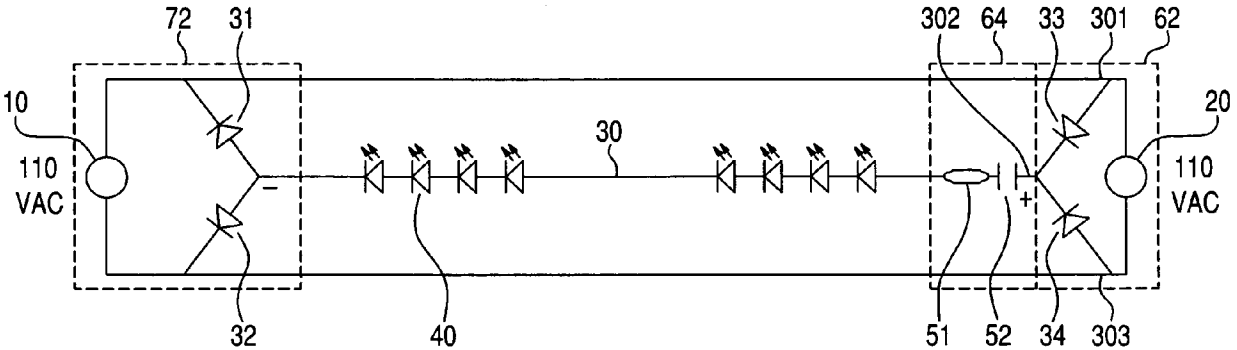
Fig. 3 Prior Art
FIG. 3 is the prior art schematic circuit diagram of a decorative lighting chain employing a single series block of LED lamps.
Figure 4:
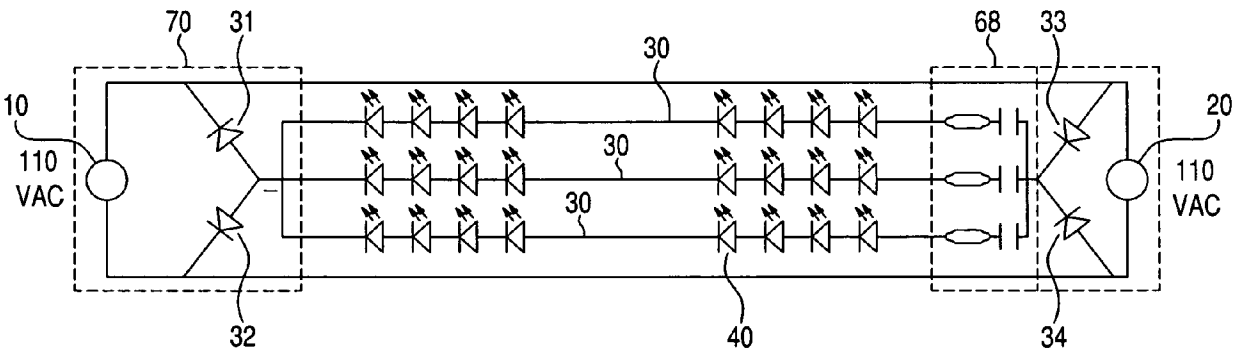
Fig. 4 Prior Art
FIG. 4 is the prior art schematic circuit diagram of a decorative lighting chain employing three series blocks of LED lamps.

As shown in FIG. 1 and FIG. 2, the present invention comprises a junction or intermediate circuit (111) to be used in conjunction with prior art plug and/or front plug area circuit (109) and rear plug and/or rear plug area circuit (110) contained in prior art.

Front plug diode pair 101 and 102 are connected to the AC parallel wires (108) of the lighting chain, forming the first half of a rectified circuit, joined by a plurality of LED lamps connected in series (107). Series wire 107 terminates in junction circuit 111 (optionally containing series resistor 105, and series capacitor) 106 and rectifying diode pair 103 and 104 which connect back to parallel wires 108, thus completing the circuit. Rectifying diode pair 101 and 102 starts a new circuit by drawing AC power from parallel wires 108, terminating in a new series connection 107 for receiving additional LEDs connected in series. See FIGS. 1A, 1B, 2A and 2B.

The rear diode pair of junction circuit 111 receives a plurality of LED lamps connected in series (107) and terminates with rear plug and circuitry 110 as shown in FIG. 1, or with subsequent junction circuit 111 as shown in FIG. 2.

Only three wires are required for a rectified circuit employing multiple series blocks of LEDs using this invention whereas, prior art would require four wires to complete the lighting chain shown in FIG. 1 and five wires to complete the lighting chain shown in FIG. 2. In addition, the additional blocks of series connected LEDs shown in the prior art places undue electrical load on the rectifying diode pairs, quickly overheating them and causing a fire hazard. This is an improvement over the lighting chain used in prior art.

It is to be understood that the above-referenced arrangements are illustrative of the application of the principles of the present invention. It will be apparent to those of ordinary skill in the art that numerous modifications can be made without departing from the principles and concepts of the invention as set forth in the following claims.

What is claimed is:

1. A light string comprising:

a front plug and a rear plug, each plug having at least one of a positive connection and a negative connection;

first and second groups of rectifying diodes, each group comprising two rectifying diodes, with negative ends of the two rectifying diodes of the first group being connected in parallel and positive ends of the two rectifying diodes of the first group being connected with the positive and negative connection of the front and rear plugs respectively, and positive ends of the two rectifying diodes of the second group being connected together in parallel and negative ends of the two rectifying diodes of the second group being connected with the positive and negative connection of the front and rear plugs respectively;

at least one junction box interposed between said first and second groups, said junction box comprising four junction diodes, with positive ends of a first two junction diodes being connected in parallel and negative ends of the first two junction diodes being connected with the positive and negative connection of the front and rear plugs respectively, and negative ends of the second two junction diodes being connected together in parallel and positive ends of the second two junction diodes being connected with the positive and negative connection of the front and rear plugs respectively;

a first LED serial set connected between the negative ends of the rectifying diodes of the first group and the positive ends of the first two junction diodes; and a second LED serial set connected between the negative ends of the second two junction diodes and the positive ends of the rectifying diodes of the second group.

2. The LED lighting chain of claim 1, further comprising a voltage-reducing device operably connected between at least one of the first and second LED serial sets and the positive ends of the rectifying diodes of the second group and the positive ends of the first two junction diodes.

3. The LED lighting chain of claim 2, wherein the voltage reducing device comprises a resistor in series with a capacitor.

4. The LED lighting chain of claim 2, wherein the voltage reducing device and the two rectifying diodes of the second group are contained in packaging for the rear plug and the two rectifying diodes of the first group are contained in packaging for the front plug.

5. The LED lighting chain of claim 1, further comprising a second junction box and a third LED serial set.

6. The LED lighting chain of claim 1, wherein the front plug comprises a common household plug connector configured to be connected to a supply voltage.

7. The LED lighting chain of claim 6, wherein the supply voltage is 110 volts.

8. The LED lighting chain of claim 6, wherein the supply voltage is 220 volts.

9. The LED lighting chain of claim 6, wherein the rear plug comprises a common household socket connector, said socket electrically coupled in parallel to the front plug, enabling a plurality of LED lighting chains to be connected to each other from end to end.

10. The LED lighting chain of claim 9, wherein the rear plug comprises a dummy plug, said dummy plug coupled in parallel to the front plug.

11. An LED lighting chain, comprising:

a first half of a bridge rectifier comprising two rectifying diodes with negative ends connected in parallel;

a second half of a bridge rectifier comprising two rectifying diodes with positive ends connected in parallel;

a first plug having at least a positive and a negative connection and comprising the first half of the bridge rectifier with the negative ends of the rectifying diodes connected to a first LED string and the positive ends of the rectifying diodes connected to the positive connection of the first plug and a negative connection of a second plug;

the second plug, having at least a positive and the negative connection and comprising the second half of the bridge rectifier with the positive ends of the rectifying diodes connected to a second LED string and the negative ends of the rectifying diodes connected to the negative connection of the first plug and the positive connection of the second plug;

at least one junction box interposed between said first and second halves of the bridge rectifier, said junction box comprising four junction diodes, with positive ends of a first two junction diodes being connected in parallel and negative ends of the first two junction diodes being connected with the positive and negative connection of the front and rear plugs respectively, and negative ends of the second two junction diodes being connected together in parallel and positive ends of the second two junction diodes being connected with the positive and negative connection of the front and rear plugs respectively;

the junction box enabling a rectified circuit employing a series connection of at least two lighting chains using only three wires thereby preventing undue electrical load on the rectifying diodes.

12. The LED lighting chain of claim 11, further comprising a voltage-reducing device operably connected between the first LED string and the positive ends of the first two junction diodes and between the second LED string and the positive ends of the rectifying diodes in the second half of the bridge rectifier.

13. The LED lighting chain of claim 12, wherein the voltage-reducing device comprises a resistor in series with a capacitor.

14. The LED lighting chain of claim 11, further comprising a second junction box and a third LED string.

15. The LED lighting chain of claim 11, wherein the first plug comprises a common household plug connector configured to be connected to a supply voltage.

16. The LED lighting chain of claim 15, wherein the supply voltage is 110 volts.

17. The LED lighting chain of claim 15, wherein the supply voltage is 220 volts.

18. The LED lighting chain of claim 11, wherein the second plug comprises a common household socket connector configured to be connected to a common household plug connector.

19. The LED lighting chain of claim 18, wherein the second plug comprises a dummy plug, said dummy plug electrically coupled in parallel to the first plug.

* * * * *